US009437383B2

(12) United States Patent
Choi

(10) Patent No.: US 9,437,383 B2
(45) Date of Patent: Sep. 6, 2016

(54) AUXILIARY CONTACT MECHANISM OF ELECTROMAGNETIC CONTACTOR

(71) Applicant: LSIS CO., LTD., Anyang-si, Gyeonggi-do (KR)

(72) Inventor: Gwan Ho Choi, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/737,324

(22) Filed: Jun. 11, 2015

(65) Prior Publication Data

US 2016/0093459 A1 Mar. 31, 2016

(30) Foreign Application Priority Data

Sep. 26, 2014 (KR) ..... 10-2014-0129419

(51) Int. Cl.
*H01H 3/00* (2006.01)
*H01H 50/58* (2006.01)
(Continued)

(52) U.S. Cl.
CPC ..... *H01H 50/58* (2013.01); *H01H 50/02* (2013.01); *H01H 50/14* (2013.01); *H01H 50/545* (2013.01); *H01H 50/541* (2013.01); *H01H 2201/008* (2013.01)

(58) Field of Classification Search
CPC ..... H01H 50/02; H01H 50/14; H01H 50/58; H01H 2201/008
USPC ..... 335/194
See application file for complete search history.

(56) References Cited

U.S. PATENT DOCUMENTS 3,296,567 A * 1/1967 Conner ..... H01H 50/545 200/50.32
3,480,892 A * 11/1969 Shizuka ..... H01H 50/22 335/132

(Continued)

FOREIGN PATENT DOCUMENTS

CN 103413700 11/2013
EP 2608241 6/2013

(Continued)

OTHER PUBLICATIONS

Korean Intellectual Property Office Application Serial No. 10-2014-0129419, Office Action dated Feb. 25, 2016, 5 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey PC; Jonathan Kang; Justin Lee

(57) ABSTRACT

The present invention relates to an auxiliary contact mechanism of an electromagnetic contactor, and more particularly, to an auxiliary contact mechanism of an electromagnetic contactor capable of maximizing a time duration for which power is supplied to a magnetic coil for switching a main contact until the main contact is closed. The auxiliary contact mechanism of an electromagnetic contactor, includes: a case formed to have a box shape; an auxiliary sliding member installed above the case, and moving up and down by receiving a pressure from a main contact sliding member; an elastic member accommodated in an insertion groove formed in the auxiliary sliding member; a pressing member insertion-installed below the auxiliary sliding member, and moving up and down by an elastic force of the elastic member; and a micro switch turned on/off by the pressing member.

11 Claims, 15 Drawing Sheets

(51) Int. Cl.

| | |
|---|---|
| ***H01H 50/02*** | (2006.01) |
| ***H01H 50/14*** | (2006.01) |
| *H01H 50/54* | (2006.01) |

(56) References Cited

U.S. PATENT DOCUMENTS 3,821,671 A * 6/1974 Grunert et al. ..... H01H 50/20 335/132
4,467,300 A * 8/1984 Harbauer ..... H01H 50/08 335/131
4,931,758 A * 6/1990 Bagalini ..... H01H 71/322 335/174
5,198,789 A * 3/1993 Taylor ..... H01H 50/541 335/132
5,241,290 A * 8/1993 Sehmer ..... H01H 71/56 335/132
7,915,984 B2 * 3/2011 Niimi ..... H01H 51/065 335/126
8,729,984 B2 * 5/2014 Feller ..... H01H 71/2463 335/119
9,177,744 B2 * 11/2015 Biessenberger ..... H01H 51/065
2006/0208591 A1 * 9/2006 Lee ..... H01F 7/1615 310/120
2010/0326802 A1 * 12/2010 Scola ..... H01H 71/465 200/303
2013/0154775 A1 * 6/2013 Choi ..... H01H 36/00 335/205
2015/0015350 A1 * 1/2015 Tachikawa ..... H01H 1/66 335/131
2015/0022292 A1 * 1/2015 Tachikawa ..... H01H 50/54 335/131

FOREIGN PATENT DOCUMENTS

| | | |
|---|---|---|
| JP | 50115557 | 9/1975 |
| JP | 6288235 | 4/1987 |
| JP | 2000276961 | 10/2000 |
| JP | 2007042359 | 2/2007 |

OTHER PUBLICATIONS

European Patent Office Application Serial No. 151711827, Search Report dated Feb. 16, 2016, 9 pages.

* cited by examiner

AUXILIARY CONTACT MECHANISM OF ELECTROMAGNETIC CONTACTOR

CROSS-REFERENCE TO RELATED APPLICATION

Pursuant to 35 U.S.C. §119(a), this application claims the benefit of earlier filing date and right of priority to Korean Application No. 10-2014-0129419, filed on Sep. 26, 2014, the contents of which is incorporated by reference herein in its entirety.

BACKGROUND OF THE INVENTION

1. Field of the Invention

The present invention relates to an auxiliary contact of an electromagnetic contactor, and more particularly, to an auxiliary contact of an electromagnetic contactor capable of maximizing a time duration for which power is supplied to a magnetic coil for switching a main contact until the main contact is closed.

2. Background of the Invention

Generally, an electromagnetic contactor is a type of electric circuit switching apparatus for performing a mechanical driving and transmitting a current signal using a principle of an electromagnet. The electromagnetic contactor is installed at various types of industrial equipment, machines, vehicles, etc.

The electromagnetic contactor may include a main contact mechanism for performing power supply to a load or disconnecting power supply to the load, and an auxiliary contact mechanism for performing power supply to a magnetic coil of the main contact mechanism or disconnecting power supply to the magnetic coil of the main contact mechanism.

FIG. 1 is a perspective view illustrating a schematic configuration of an electromagnetic contactor in accordance with the conventional art.

The conventional electromagnetic contactor 100 includes a main contact mechanism and an auxiliary contact mechanism 3. The main contact mechanism includes a main contact slide supporting member 1 and a magnetic coil 2. An auxiliary contact pressing portion 1*a*, which protrudes toward the auxiliary contact mechanism 3, is provided at part of the main contact slide supporting member 1. The auxiliary contact pressing portion 1*a* drives the auxiliary contact mechanism 3 while being moved up and down together with the main contact slide supporting member 1.

FIG. 2 is a view illustrating a configuration of an auxiliary contact of the electromagnetic contactor of FIG. 1, which shows a closed circuit state. FIG. 3 is a view illustrating a configuration of an auxiliary contact of the electromagnetic contactor of FIG. 1, which shows an open circuit state.

A configuration and an operation of the auxiliary contact mechanism 3 of the conventional electromagnetic contactor will be explained in more detail with reference to FIGS. 2 and 3.

The auxiliary contact mechanism 3 of the conventional electromagnetic contactor includes a contact supporting member 3*a*, a slide motion supporter 3*b*, a fixed contactor 3*c*, a movable contactor 3*d*, an auxiliary contact spring 3*e*, and a return spring 3*f*.

The contact supporting member 3*a* is fixedly-installed in a coil assembly accommodation container 4. The fixed contactor 3*c* is fixedly-installed at the contact supporting member 3*a*, and a shaft groove 3*a*1 for inserting the slide motion supporter 3*b* is formed at the contact supporting member 3*a*.

The slide motion supporter 3*b* moves up and down in a vertical direction through the shaft groove 3*a*1 of the contact supporting member 3*a*, and the movable contactor 3*d* is coupled to a central part of the slide motion supporter 3*b*.

The fixed contactor 3*c* is formed as a pair, and the pair of fixed contactors 3*c* are installed at the contact supporting member 3*a*. Each of the fixed contactors 3*c* includes a terminal portion exposed to outside, and a contact portion disposed therein. One of the fixed contactors 3*c* may be connected to an external power, and another may be connected to the magnetic coil 2 of the main contact.

The movable contactor 3*d* moves up and down along the slide motion supporter 3*b*, and is contactable to or separable from the fixed contactor 3*c*.

The auxiliary contact spring 3*e* is installed between a bottom surface of a central part of the movable contactor 3*d*, and a spring supporting protrusion formed below the slide motion supporter 3*b*. The auxiliary contact spring 3*e* provides an elastic force to press the movable contactor 3*d* toward the fixed contactor 3*c*.

The return spring 3*f* is installed between a lower end of the slide motion supporter 3*b* and a bottom surface of the contact supporting member 3*a*, and provides an elastic force to upward-move the slide motion supporter 3*b*.

An operation of the electromagnetic contactor to a closing position (ON' position) will be explained.

As shown in FIG. 2, once an external control power is applied to the auxiliary contact mechanism 3 in a contacted state between the fixed contactor 3*c* and the movable contactor 3*d*, a current flows to the magnetic coil 2 of FIG. 1. If a magnetic force is generated from the magnetic coil 2, a movable core (not shown) and the main contact slide supporting member 1 are sucked downward. Accordingly, a main contact movable contactor (not shown) coupled to the main contact slide supporting member 1 comes in contact with a main contact fixed contactor (not shown) disposed below the main contact movable contactor. As a result, a main circuit is in a closed state.

In this instance, as shown in FIG. 3, the auxiliary contact pressing portion 1*a* integrally connected to the main contact slide supporting member 1 downward-presses an upper end of the slide motion supporter 3*b*, while being moved downward. Thus, the slide motion supporter 3*b* and the movable contactor 3*d* overcome an elastic force of the auxiliary contact spring 3*e* and the return spring 3*f*, and move downward. Accordingly, the movable contactor 3*d* of the auxiliary contact mechanism 3 is separated from the fixed contactor 3*c*, and a control power supplied to the main contact through the auxiliary contact mechanism 3 is cut off. Then, the main contact maintains a closed circuit state through a holding current flowing on the magnetic coil 2.

An operation of the electromagnetic contactor to an opening position ('OFF' position) will be explained.

Once a control power supplied from outside is completely cut off, a current flowing on the magnetic coil 2 disappears. Thus, a magnetic suction force for downward-sucking the movable core and the main contact slide supporting member 1 disappears, and the main contact slide supporting member 1 is moved upward by an elastic force of the return spring 3*f*. As a result, the main circuit is in an open state.

As the auxiliary contact pressing portion 1*a* is also moved upward together with the main contact slide supporting member 10, a pressure which was downward-pressing an upper end of the slide motion supporter 3*b* disappears.

Accordingly, the slide motion supporter 3*b* and the movable contactor 3*d* are moved upward by an elastic force of the auxiliary contact spring 3*e* and the return spring 3*f*. As a result, the movable contactor 3*d* of the auxiliary contact mechanism 3 comes in contact with the fixed contactor 3*c*, and waits for a next control power to be supplied.

However, the conventional electromagnetic contactor has the following problems.

The fixed contactor 3*c* receives an operating load of the auxiliary contact pressing portion 1*a* through the slide motion supporter 3*b* instantly. That is, a movement distance of the slide motion supporter 3*b* is the same as that of the main contact slide supporting member 1. And a time when the auxiliary contact pressing portion 1*a* contacts the slide motion supporter 3*b* determines a time point when the movable contactor 3*d* is separated from the fixed contactor 3*c*.

If such contact time is set at an early time of an operation time of the main contact, the auxiliary contact is open before an operation of the main contact to a closing position is completed. As a result, supply of the control power to the magnetic coil 2 is stopped. This may cause the operation of the main contact to a closing position not to be completed.

Further, if such contact time is set after the operation time of the main contact, a current is continuously supplied to the magnetic coil 2 through the auxiliary contact until an operation of the main contact to a closing position is completed. This may cause damage of the magnetic coil 2 or a chattering phenomenon of the main contact.

In the auxiliary contact of the conventional electromagnetic contactor, since the auxiliary contact spring 3*e* and the return spring 3*f* are formed as compression coil springs, time or load taken or required to contact the fixed contactor 3*c* and the movable contactor 3*d* each other is almost the same as time or load taken or required to separate the fixed contactor 3*c* and the movable contactor 3*d* from each other. That is, a load required when the movable contactor 3*d* is separated from the fixed contactor 3*c* is almost the same as a load required when the movable contactor 3*d* comes in contact with the fixed contactor 3*c*. This may cause a disadvantage that different operation starting points cannot be set when the main contact is closed and open.

SUMMARY OF THE INVENTION

Therefore, an aspect of the detailed description is to provide an auxiliary contact mechanism of an electromagnetic contactor capable of supplying a control power to a magnetic coil for switching a main contact, up to a point closest to a point where an operation of a main contact sliding member is completed, for a stable closed state of the main contact.

To achieve these and other advantages and in accordance with the purpose of this specification, as embodied and broadly described herein, there is provided an auxiliary contact mechanism of an electromagnetic contactor, including: a case formed to have a box shape; an auxiliary sliding member installed above the case, and moving up and down by receiving a pressure from a main contact sliding member; an elastic member accommodated in the auxiliary sliding member; a pressing member insertion-installed below the auxiliary sliding member, and moving up and down by an elastic force of the elastic member; and a micro switch turned on/off by the pressing member.

In an embodiment, the elastic member may be formed as a compression coil spring.

In an embodiment, the auxiliary sliding member may be provided with a locking portion protruding inward at a lower end thereof. A locking groove for locking the locking portion may be formed above the pressing member.

In an embodiment, the pressing member may be formed so that an outer diameter thereof is smaller than an inner diameter of the insertion groove of the auxiliary sliding member.

In an embodiment, the micro switch may include a housing; a pair of terminals fixedly-installed in the housing and exposed to outside of the housing partially; a leaf spring configured to connect or disconnect the pair of terminals to or from each other; and a contact button configured to apply a force to the leaf spring by the pressing member.

In an embodiment, a minimum operating load of the elastic member may be set to be smaller than a returning load required when the micro switch is closed. And a maximum operating load of the elastic member may be set to be larger than an operating load required when the micro switch is open.

In an embodiment, a second elastic member may be disposed between the auxiliary sliding member and the micro switch.

In an embodiment, the auxiliary contact mechanism may further include a second sliding member which performs an up/down motion within the auxiliary sliding member. The elastic member may include a first spring disposed between a protrusion and an upper surface of the second sliding member, and a second spring disposed between a lower surface of the second sliding member and the pressing member.

In an embodiment, a spring constant of the first spring may be set to be smaller than that of the second spring.

In an embodiment, a maximum operating load of the first spring may be set between an operating load required when the micro switch is open, and a returning load required when the micro switch is closed.

In an embodiment, an operating load of the second spring may be set to be larger than an operating load required when the micro switch is open.

The auxiliary contact mechanism of the electromagnetic contactor according to an embodiment of the present invention can have the following advantages.

Firstly, an operation starting points of the auxiliary contact mechanism can be arbitrarily set within an operation time of the main contact. That is, since the micro switch including the leaf spring is applied to the auxiliary contact, starting points for an opening operation and a closing operation of an auxiliary contact circuit are differently set. As a result, an operation gap is generated. Especially, in case of closing the main contact, the auxiliary contact circuit maintains a closed state to the maximum until when an operation of the main contact to a closing position is completed.

This can prevent an operation of the main contact to a closing position from being terminated incompletely. Further, damage which may occur on the magnetic coil of the main contact can be prevented, and a chattering phenomenon can be prevented.

Further, the operation gap generated when an opening operation and a closing operation are performed can be increased as the elastic member is included in the auxiliary sliding member. Also, since two springs having different spring constants are applied, an operation position of the auxiliary contact mechanism can be set.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIG. 6A illustrates a closed state of an auxiliary contact circuit, and FIG. 6B illustrates an open state of the auxiliary contact circuit;

FIG. 9A illustrates a state before a force is applied to an auxiliary sliding member, FIG. 9B illustrates a state where a pressing member has contacted a contact button, and FIG. 9C illustrates a state where an auxiliary contact mechanism is open; FIG. 10A illustrates a state where an auxiliary contact mechanism is open, FIG. 10B illustrates a state where an open circuit state is being converted into a closed circuit state, FIG. 10C illustrates a state where an auxiliary contact mechanism is closed.

DETAILED DESCRIPTION OF THE INVENTION

Description will now be given in detail of preferred configurations of an auxiliary contact mechanism of an electromagnetic contactor according to the present invention, with reference to the accompanying drawings.

Figure 1:
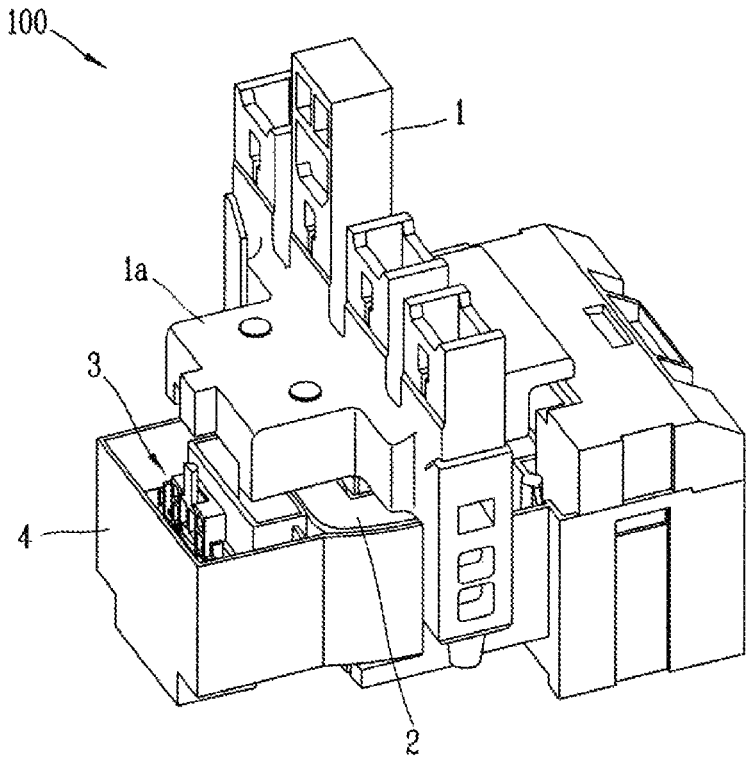
Fig. 1 Prior Art
FIG. 1 is a perspective view illustrating a schematic configuration of an electromagnetic contactor in accordance with the conventional art.
Figure 2:
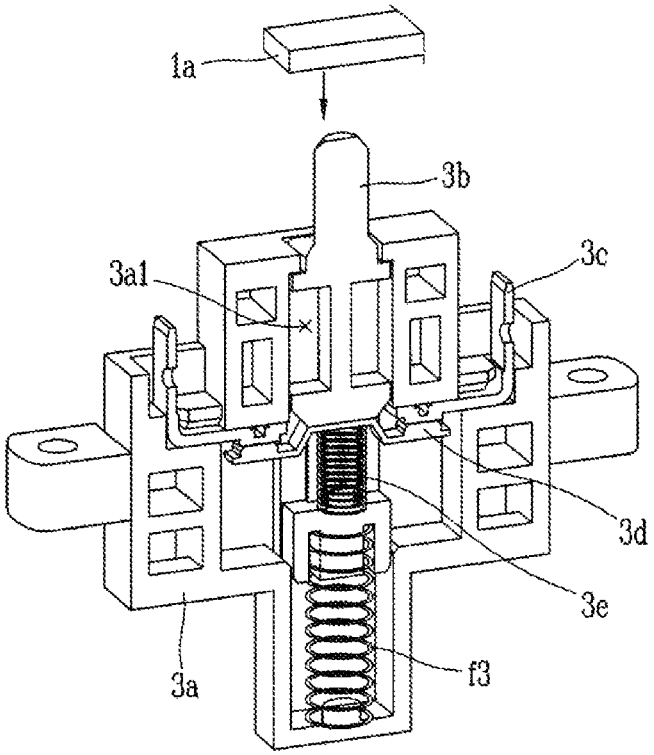
Fig. 2 Prior Art
FIG. 2 is a view illustrating a configuration of an auxiliary contact mechanism of the electromagnetic contactor of FIG. 1, which shows a closed circuit state.
Figure 3:
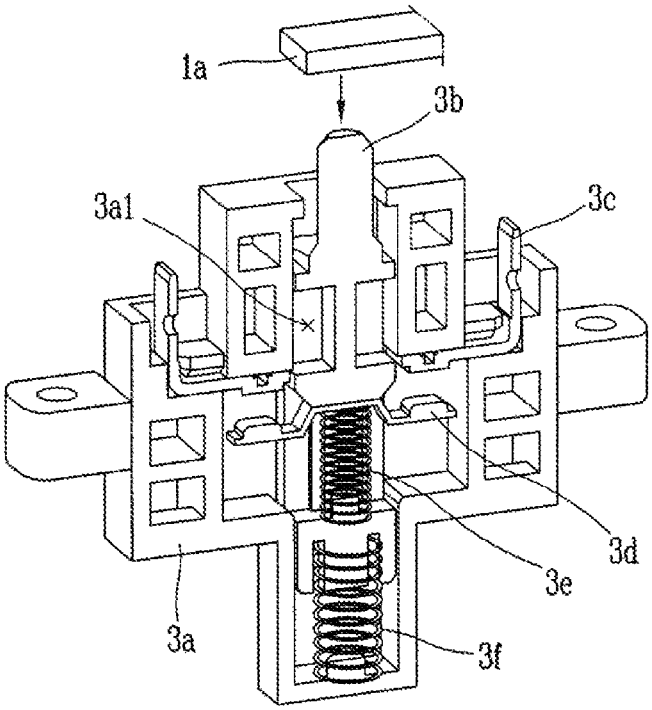
Fig. 3 Prior Art
FIG. 3 is a view illustrating a configuration of an auxiliary contact mechanism of the electromagnetic contactor of FIG. 1, which shows an open circuit state.
Figure 4:
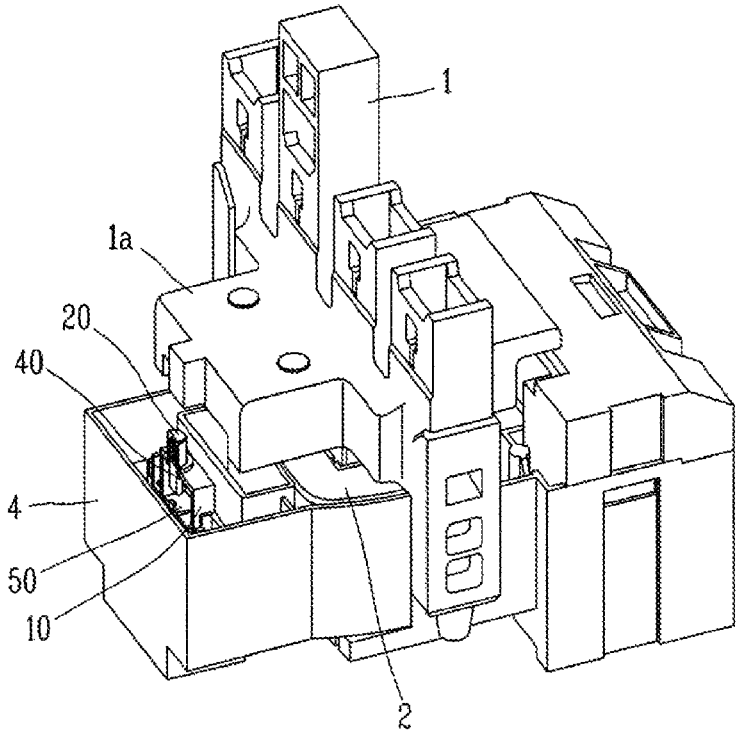
FIG. 4 is a perspective view illustrating a schematic configuration of an electromagnetic contactor including an auxiliary contact mechanism according to an embodiment of the present invention.
Figure 5:
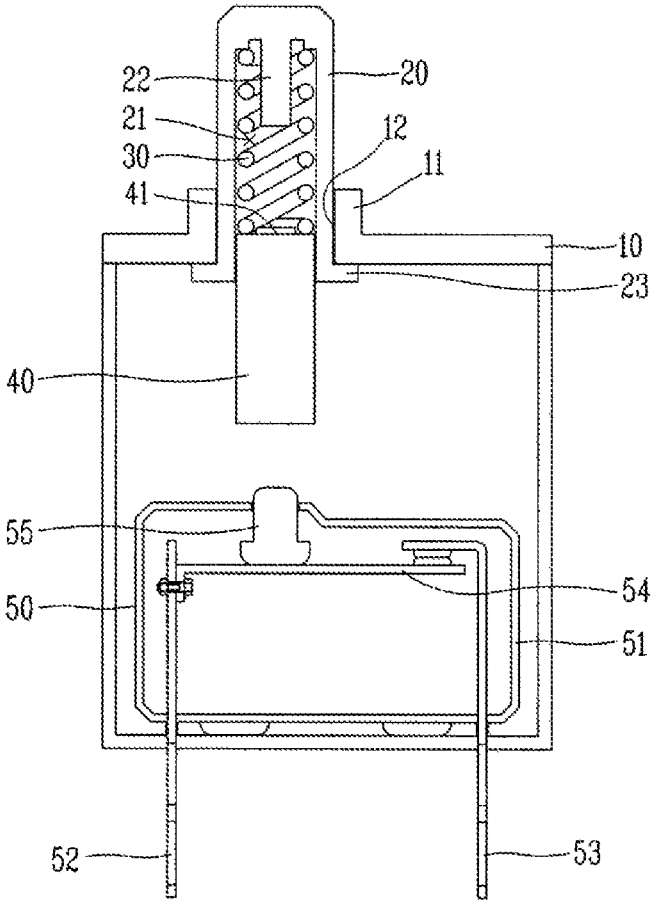
FIG. 5 is a front view of the auxiliary contact mechanism of the electromagnetic contactor of FIG. 4.

FIG. 4 is a perspective view illustrating a schematic configuration of an electromagnetic contactor including an auxiliary contact mechanism according to an embodiment of the present invention, and FIG. 5 is a front view of the auxiliary contact mechanism of the electromagnetic contactor of FIG. 4.

An auxiliary contact mechanism of an electromagnetic contactor according to an embodiment of the present invention includes a case 10 formed to have a box shape; an auxiliary sliding member 20 which moves up and down by receiving pressure from a main contact sliding member 1; an elastic member 30 accommodated in the auxiliary sliding member 20; a pressing member 40 insertion-installed below the auxiliary sliding member 20, and moving up and down by an elastic force of the elastic member 30; and a micro switch 50 turned on/off by the pressing member.

The case 10 is formed to have an approximate box shape. A front surface of the case 10 may be open. A supporting portion 11 for supporting the auxiliary sliding member 20, which is to be explained later, may protrudingly-formed above the case 10. The supporting portion 11 is provided with a sliding hole 12 penetratingly-formed at a central part thereof.

The auxiliary sliding member 20 may be formed to have an approximate piston shape. The auxiliary sliding member 20 is insertion-installed at the sliding hole 12 of the supporting portion 11. An insertion groove 21 for inserting the elastic member 30, which is to be explained later, is formed in the auxiliary sliding member 20. A protrusion 22 for fixing an upper end of the elastic member 30 protrudes from an upper part of the insertion groove 21. A lower end 23 of the auxiliary sliding member 20 is bent outward to thus be locked by a lower part of the supporting portion 11.

The elastic member 30 is insertion-installed at the insertion groove 21 of the auxiliary sliding member 20. The elastic member 30 may be formed as a compression coil spring. An upper end of the elastic member 30 is fixed to the protrusion 22 of the auxiliary sliding member 20, and a lower end of the elastic member 30 is fixed to an upper part of the pressing member 40 to be explained later.

The pressing member 40 may be formed to have a bar shape. A coupling portion 41, fixed to a lower end of the elastic member 30, may be formed at an upper end of the pressing member 40. The coupling portion 41 formed at the upper end of the pressing member 40 is fixed to the lower end of the elastic member 30, and the upper end of the elastic member 30 is fixed to the protrusion 22 of the auxiliary sliding member 20. Thus, the pressing member 40 is in a suspended state without being separated from the auxiliary sliding member 20. The pressing member 40 is formed such that an outer diameter thereof can be smaller than an inner diameter of the insertion groove 21 of the auxiliary sliding member 20. The pressing member 40 may perform a sliding motion within the insertion groove 21 with maintaining a proper frictional force, as the inner diameter of the insertion groove 21 and the outer diameter of the pressing member 40 are properly controlled. Lubricating oil may be applied between the insertion groove 21 and the pressing member 40.

The micro switch 50 is installed below the case 10. The micro switch 50 includes a housing 51, a pair of terminals 52, 53 fixedly-installed in the housing 51 with a distance therebetween and exposed to outside of the housing partially, a leaf spring 54 configured to connect or disconnect the pair of terminals 52, 53 to or from each other, and a contact button 55 configured to press the leaf spring 54. As the micro switch 50, a ready-made product may be used.

Figure 6A:
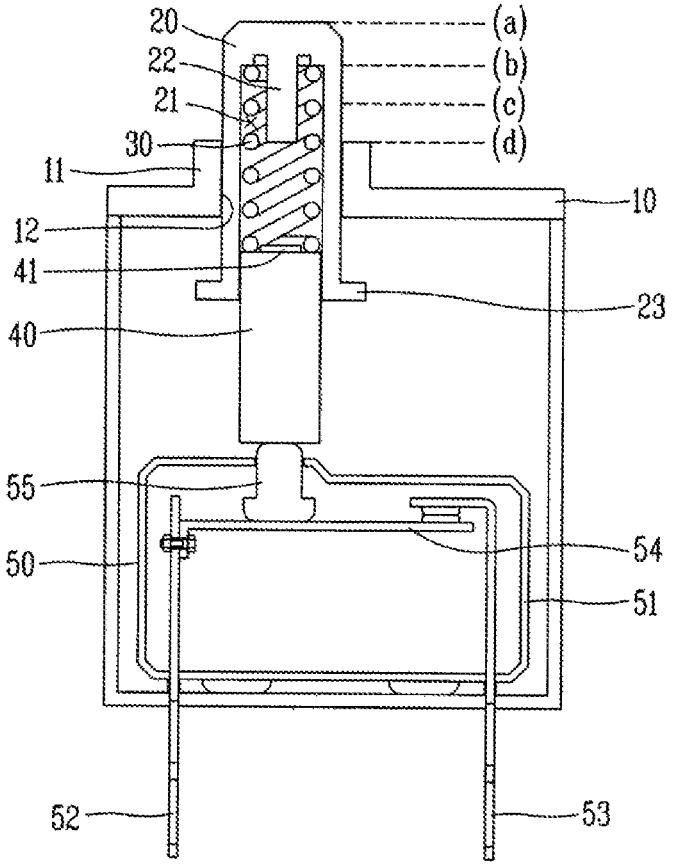
FIGS. 6A and 6B are views illustrating an operation state of the auxiliary contact mechanism of the electromagnetic contactor of FIG. 5.
Figure 6B:
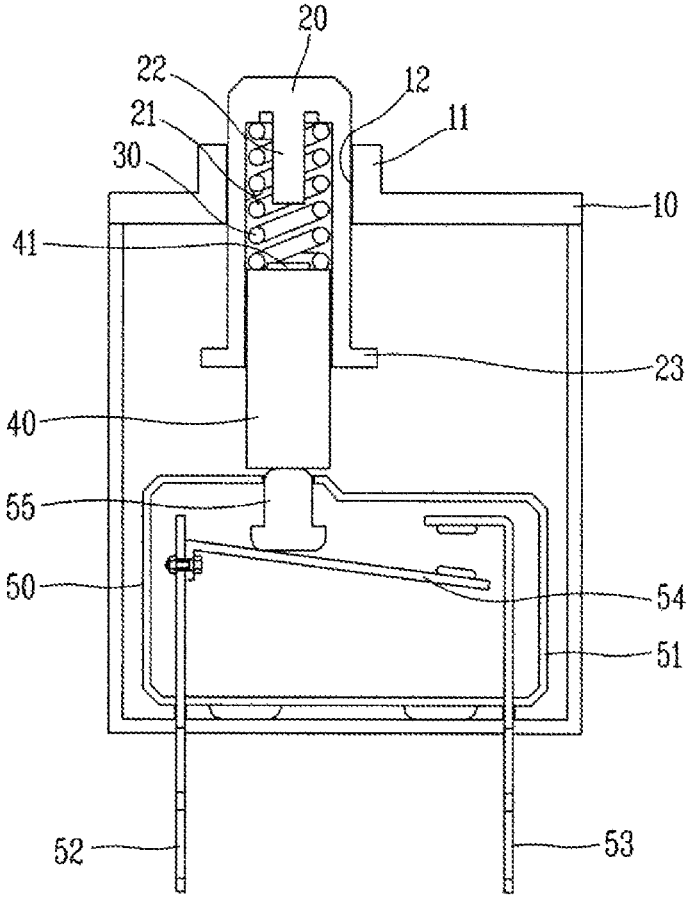

If the contact button 55 of the micro switch 50 has not been pressed as shown in FIG. 5, an auxiliary contact circuit is closed, because the leaf spring 54 of the micro switch 50 is connected to the left terminal 52 and the right terminal 53. On the other hand, if the contact button 55 of the micro switch 50 has been pressed as shown in FIG. 6B, the auxiliary contact circuit is open, because the leaf spring 54 of the micro switch 50 is separated from the right terminal 53. Different loads are required for an opening operation and a closing operation of the micro switch 50 due to characteristics of the leaf spring 54. For instance, a load (operating load) required to perform an opening operation of the micro switch 50 may be greater than a load (returning load) required to perform a closing operation of the micro switch 50.

An operation of the auxiliary contact mechanism of an electromagnetic contactor according to an embodiment of the present invention will be explained in more detail with reference to FIGS. 5, 6A and 6B.

FIG. 5 illustrates a closed state of the auxiliary contact circuit. If the auxiliary sliding member 20 is pressed by an auxiliary contact mechanism pressing portion 1*a* as a closing operation of the main contact is performed, the auxiliary sliding member 20 is moved downward together with the elastic member 30 as shown in FIG. 6A. If the pressing member 40 comes in contact with the contact button 55 of the micro switch 50, a pressing force of the auxiliary contact mechanism pressing portion 1*a* compresses the elastic member 30. If the pressing force exceeds a minimum operating load of the elastic member 30, the pressing member 40 is pressed so that the contact button 55 can be operated by the pressing member 40 (refer to FIG. 6B). As the contact button 55 is pressed, the auxiliary contact circuit is open.

During an opening operation of the main contact, the auxiliary contact mechanism pressing portion 1*a* is moved upward so that pressure applied to the elastic member 30 is reduced and the pressing member 40 is moved upward. As a result, the contact button 55 is restored so that the auxiliary contact circuit is closed to wait for a next control power.

This will be explained in more detail.

As aforementioned, the micro switch 50 is operated to open and close the auxiliary contact circuit with different loads, due to characteristics of the leaf spring 54. For instance, an operating load of the micro switch 50 is set as 120 g during an opening operation, and a returning load of the micro switch 50 is set as 80 g during a closing operation. And an operating load of the elastic member 30 is set as 50 g~150 g.

Firstly, an opening operation of the auxiliary contact mechanism (a closing operation of the main contact) will be explained.

If a load applied to the auxiliary sliding member 20 by the auxiliary contact mechanism pressing portion 1*a* is 0~50 g, the elastic member 30 is not compressed. That is, the auxiliary sliding member 20 is disposed at a position '(a)' in FIG. 6A. However, if the load applied to the auxiliary sliding member 20 exceeds 50 g, the elastic member 30 is compressed so that the auxiliary sliding member 20 starts to move downward. If the load applied to the auxiliary sliding member 20 is 120 g, the auxiliary sliding member 20 is disposed at a position '(c)' in FIG. 6A so that the contact button 55 of the micro switch 50 can be operated. Thus, a control power supplied to the main contact is cut off. If the load applied to the auxiliary sliding member 20 is 150 g, the auxiliary sliding member 20 is disposed at a position '(d)' in FIG. 6A.

FIG. 6B illustrates an open state of the auxiliary contact circuit, which corresponds to a point between (c) and (d).

That is, the micro switch 50 is operated at a section between (c) and (d). More specifically, at a section from (a) to (c), the micro switch 50 is not operated whereas the auxiliary sliding member 20 is moved downward. A closed state of the auxiliary contact mechanism is maintained to the maximum until a closing operation of the main contact is completed.

Next, a closing operation of the auxiliary contact mechanism (an opening operation of the main contact) will be explained.

If a control power supplied to a magnetic coil 2 is completely cut off, the operating load by the auxiliary contact mechanism pressing portion 1*a* starts to be reduced. While 80~150 g of load is applied to the auxiliary sliding member 20, the contact button 55 of the micro switch 50 maintains an open state as shown in FIG. 6B. If the operating load is 80 g, the auxiliary sliding member 20 is operated to be disposed at a position '(b)' in FIG. 6A. If the load applied to the auxiliary sliding member 20 is reduced to a value less than 80 g, the contact button 55 is moved upward so that the micro switch 50 can be in a closed state. Thus, the auxiliary contact mechanism is in a closed state to wait for a next control power. An operation to return the micro switch 50 during a closing operation is performed within a range of (a)~(b).

Thus, an operation gap ((b)~(c)) is formed between an operation section ((c)~(d)) for opening the auxiliary contact mechanism and a returning operation section ((a)~(b)) for closing the auxiliary contact. Due to such operation gap, the auxiliary contact mechanism can maintain a conducted state until a closing operation of the main contact is almost completed.

Owing to a configuration of the elastic member 30, the operation gap may be increased and a conversion time point of the micro switch 50 may be set. That is, a minimum operating load of the elastic member 30 may be set to be smaller than a returning load required when the micro switch 50 is closed. On the other hand, a maximum operating load of the elastic member 30 may be set to be larger than an operating load required when the micro switch 50 is open. In the above example, an operating load of the micro switch 50 is set as 80~120 g, and an operating load of the elastic member 30 is set as 50~150 g. As the operating load of the elastic member 30 is controlled, a conversion time point of the micro switch 50 may be set.

Under such a configuration, one of attainable effects is as follows.

As an opening operation of the auxiliary contact mechanism is maintained to the maximum until a closing operation of the main contact is completed, damage or a chattering phenomenon of the main contact can be prevented.

Figure 7:
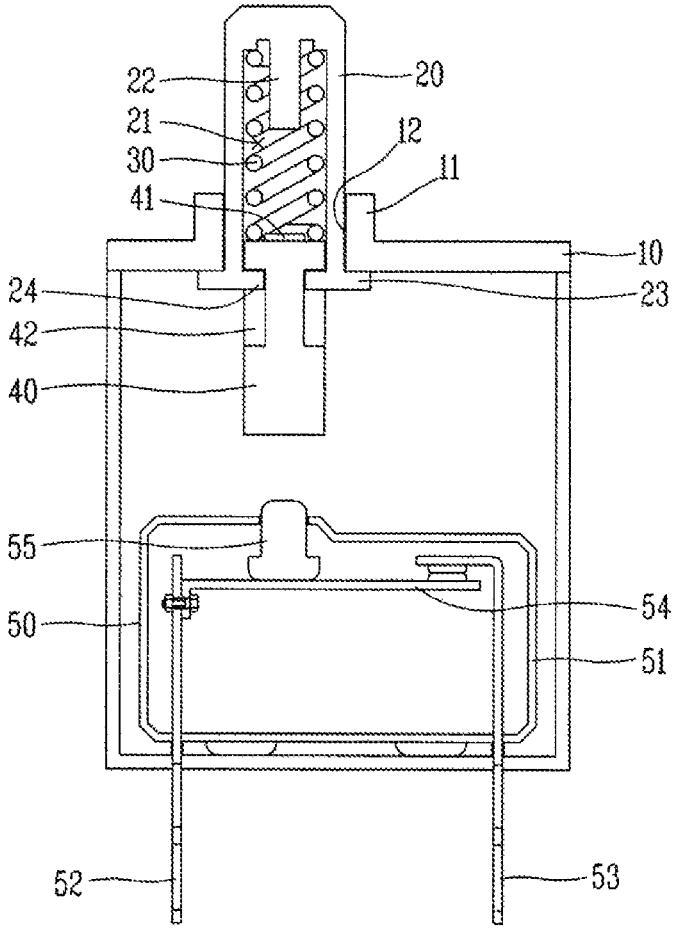
FIG. 7 is a front view of an auxiliary contact mechanism of an electromagnetic contactor according to another embodiment of the present invention.

FIG. 7 is a front view of an auxiliary contact mechanism of an electromagnetic contactor according to another embodiment of the present invention.

In this embodiment, the auxiliary sliding member 20 is provided with a locking portion 24 formed inward at a lower end thereof. A locking groove 42 is formed at part of the pressing member 40 in a lengthwise direction. Since the locking portion 24 of the auxiliary sliding member 20 is inserted into the locking groove 42 of the pressing member 40, the pressing member 40 stably performs a sliding motion without being separated from the auxiliary sliding member 20.

Figure 8:
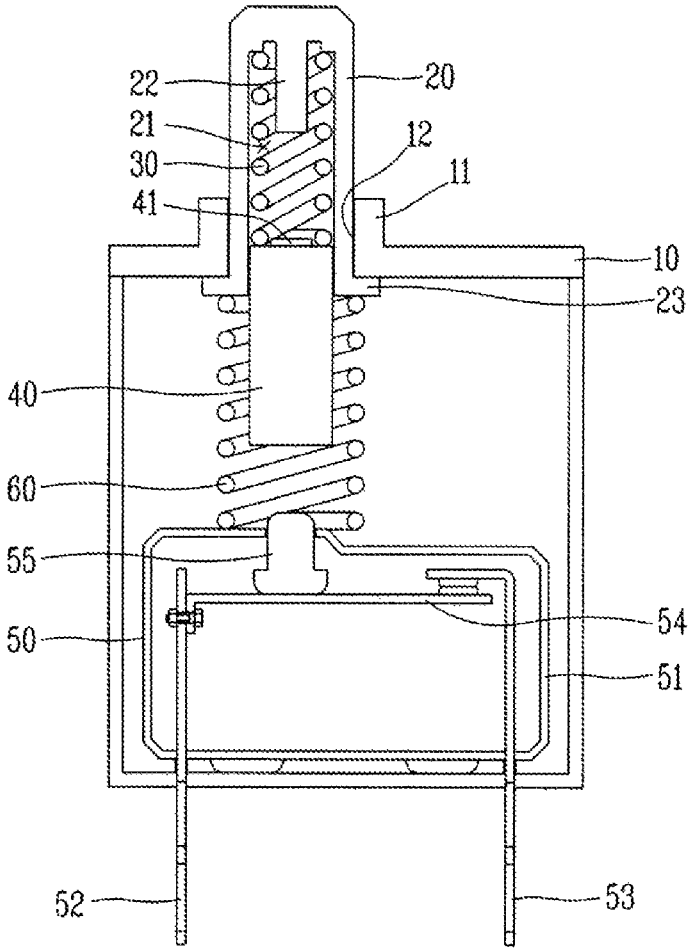
FIG. 8 is a front view of an auxiliary contact mechanism of an electromagnetic contactor according to still another embodiment of the present invention.

FIG. 8 is a front view of an auxiliary contact mechanism of an electromagnetic contactor according to still another embodiment of the present invention.

In this embodiment, a second elastic member 60 is disposed between a lower end of the auxiliary sliding member 20 and the micro switch 50. The second elastic member 60 may be configured as a compression coil spring. Thus, a larger load is required for the contact button 55 of the micro switch 50 to be pressed as the main contact sliding member 1 presses the auxiliary sliding member 20. This can allow time taken to open the auxiliary contact mechanism to be increased.

Figure 9A:
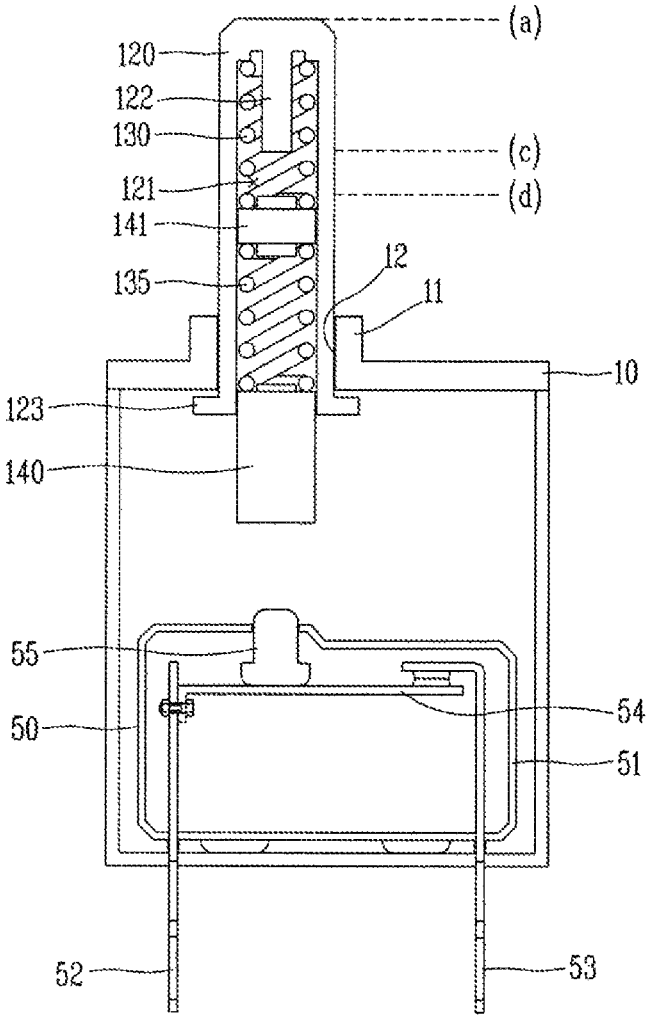
FIGS. 9A, 9B and 9C are views illustrating an opening operation of an auxiliary contact mechanism of an electromagnetic contactor according to still another embodiment of the present invention.
Figure 9B:
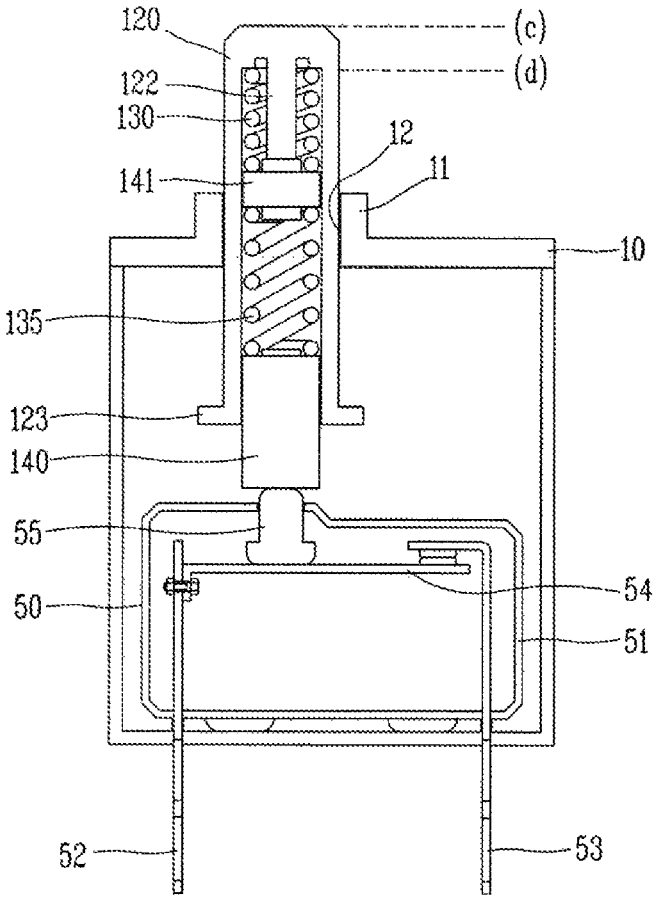
Figure 9C:
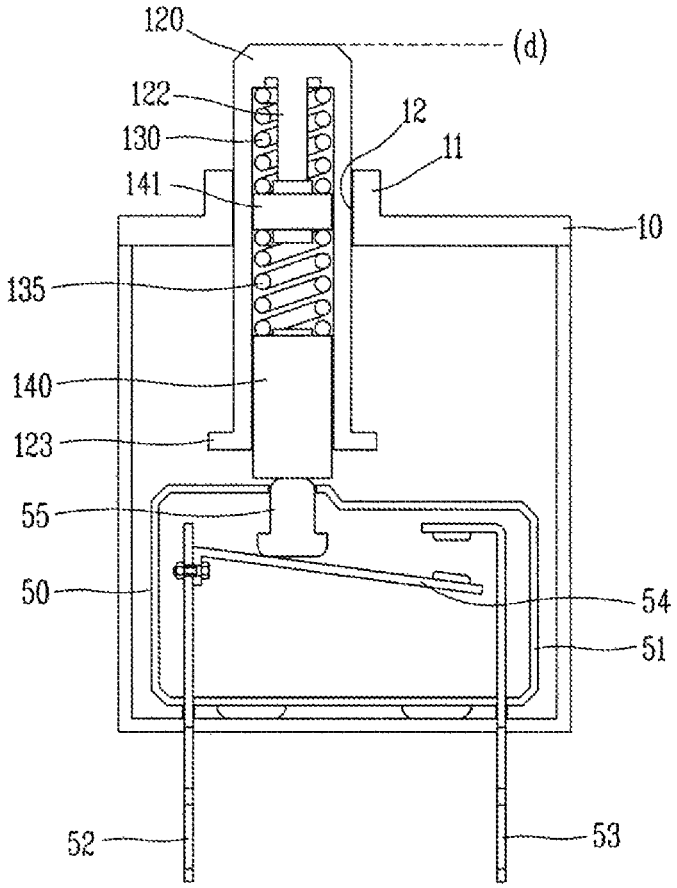

FIGS. 9A to 9C are views illustrating an auxiliary contact mechanism of an electromagnetic contactor according to still another embodiment of the present invention.

The auxiliary contact mechanism according to this embodiment includes an auxiliary sliding member 120, a second sliding member 141 which performs an up/down motion within the auxiliary sliding member 120, a first spring 130 disposed between a protrusion 122 of the auxiliary sliding member 120 and the second sliding member 141, a second spring 135 connected to a lower part of the second sliding member 141, and a pressing member 140 connected to a lower part of the second spring 135 and performing an up/down motion. The case 10 and the micro switch 50 according to the aforementioned embodiment may be used.

The auxiliary sliding member 120, similar to the auxiliary sliding member 20 of the aforementioned embodiment or having a larger length than the auxiliary sliding member 20 of the aforementioned embodiment, may be used.

A spring constant of the first spring 130 is set to be smaller than that of the second spring 135. That is, the first spring 130 is configured as a spring having a smaller strength than the second spring 135.

An operation of the auxiliary contact mechanism according to this embodiment will be explained with reference to FIGS. 9A to 9C.

If a pressure applied to the auxiliary sliding member 120 in a state of FIG. 9A exceeds a minimum operating load of the first spring 130, the first spring 130 is compressed, and the auxiliary sliding member 120 is moved downward together with the pressing member 140. As the pressure applied to the auxiliary sliding member 120 is increased, the first spring 130 is completely compressed, and the protrusion 122 presses the second sliding member 141 (refer to FIG. 9B). Accordingly, the second spring 135 is compressed, and the pressing member 140 presses the contact button 55. As a result, the micro switch 50 is converted into an open state (refer to FIG. 9C). A position '(a)' indicates an initial position of the auxiliary sliding member 120, a position '(c)' indicates a position where the pressing member 140 is operated by contacting the contact button 55, and a position '(d)' indicates a position where a load larger than an operating load of the micro switch 50 is applied.

As a spring constant of the first spring 130 and a spring constant of the second spring 135 are properly set, the protrusion 122 may come in contact with the second sliding member 141 at the position '(c)' where the pressing member 140 contacts the contact button 55 (refer to FIG. 9B).

Figure 10A:
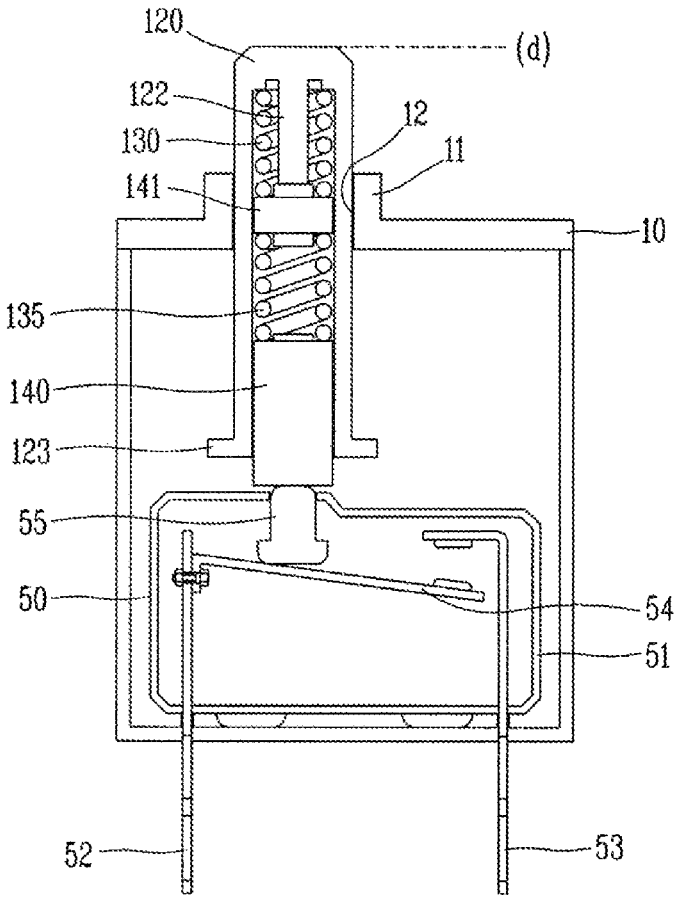
FIGS. 10A, 10B and 10C are views illustrating a closing operation of an auxiliary contact mechanism of an electromagnetic contactor according to still another embodiment of the present invention.
Figure 10B:
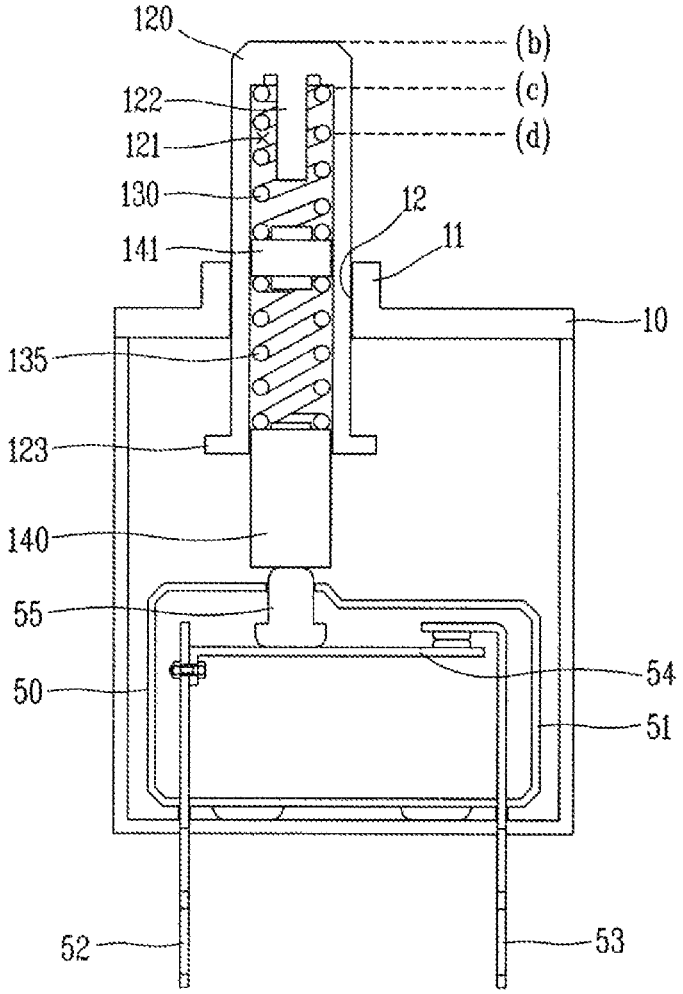
Figure 10C:
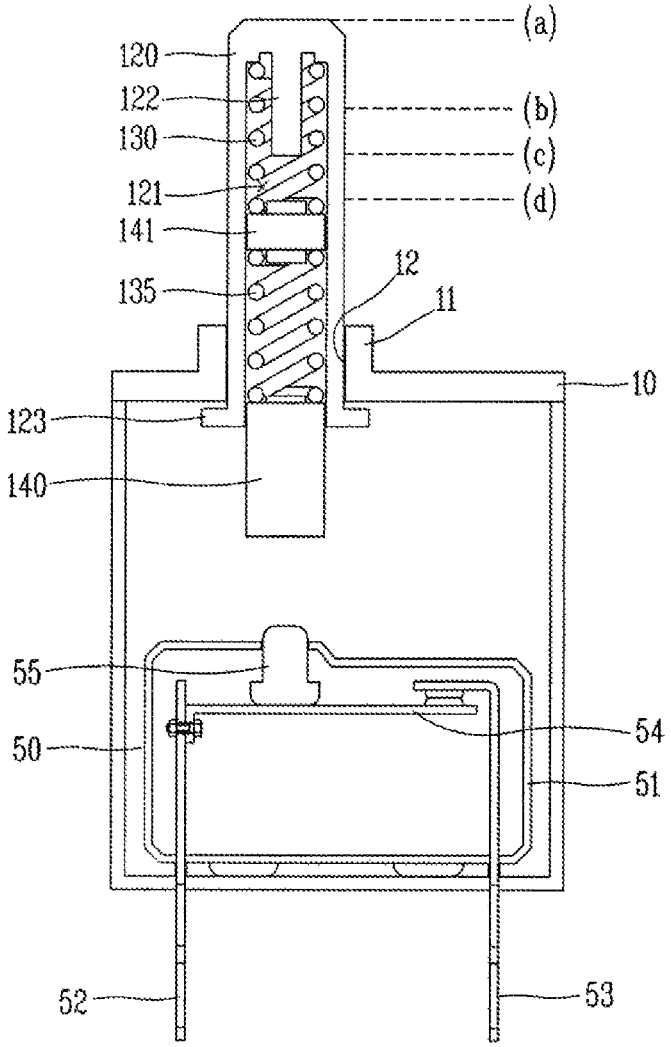

An operation to close the auxiliary contact mechanism is as follows. As the pressure applied to the auxiliary sliding member 120 is decreased, the auxiliary sliding member 120 is moved upward. The second spring 135 is firstly restored, and then the first spring 130 is restored to return to an initial position. At a section from (d) to (c), the second spring 135 having a larger strength may be restored and then the first spring 130 may be restored. When the auxiliary sliding member 120 reaches a position '(b)' via the position '(c)', the contact button 55 of the micro switch 50 is restored, because a returning load is smaller than an operating load due to characteristics of the leaf spring 54 of the micro switch 50. As a result, the auxiliary contact mechanism is converted into an 'ON' state (refer to FIG. 10B).

A maximum operating load of the first spring 130 may be set between an operating load required when the micro switch 50 is open, and a returning load required when the micro switch 50 is closed. For instance, if an operating load required when the micro switch 50 is open is 120 g, and if a returning load required when the micro switch 50 is closed is 80 g, an operating load of the first spring 130 may be set within a range of 50~100 g. Under such a configuration, since the micro switch 50 is disposed as it is at a section where the first spring 130 is compressed, time taken to convert the micro switch 50 is increased.

An operating load of the second spring 135 may be set to be larger than an operating load required when the micro switch 50 is open, for an 'off' state of the micro switch 50 when the second spring 135 is operated. For instance, the operating load of the second spring 135 may be set to be more than 120 g.

As an elastic force of the first spring 130 and the second spring 135 is controlled, an operation position of the auxiliary contact mechanism may be set. Further, since a position where the micro switch 50 is converted is fixed to a specific position, the auxiliary contact mechanism can perform an operation with reliability.

The auxiliary contact mechanism of an electromagnetic contactor according to an embodiment of the present invention has the following advantages.

Firstly, an operation starting points of the auxiliary contact mechanism can be arbitrarily set within an operation time of the main contact. That is, since the micro switch including the leaf spring is applied to the auxiliary contact, starting points for an opening operation and a closing operation of the auxiliary contact circuit are differently set. As a result, an operation gap is generated. Especially, in case of closing the main contact, the auxiliary contact circuit maintains a closed state to the maximum until when an operation of the main contact to a closing position is completed.

This can prevent an operation of the main contact to a closing position from being terminated incompletely. Further, damage which may occur on the magnetic coil of the main contact can be prevented, and a chattering phenomenon can be prevented.

Further, the operation gap generated when an opening operation and a closing operation are performed can be increased as the elastic member is included in the auxiliary sliding member. Also, since two springs having different spring constants are applied, an operation position of the auxiliary contact mechanism can be set.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An auxiliary contact mechanism of an electromagnetic contactor, comprising:

a case formed to have a box shape;

an auxiliary sliding member installed above the case, and moving up and down by receiving a pressure from a main contact sliding member;

an elastic member accommodated in an insertion groove formed in the auxiliary sliding member;

a pressing member insertion-installed in an insertion groove, and moving up and down by an elastic force of the elastic member; and a micro switch turned on/off by the pressing member.

2. The auxiliary contact mechanism of an electromagnetic contactor of claim 1, wherein the elastic member is formed as a compression coil spring.

3. The auxiliary contact mechanism of an electromagnetic contactor of claim 1, wherein the auxiliary sliding member is provided with a locking portion protruding inward at a lower end thereof, and wherein a locking groove for locking the locking portion is formed above the pressing member.

4. The auxiliary contact mechanism of an electromagnetic contactor of claim 3, wherein the pressing member is formed so that an outer diameter thereof is smaller than an inner diameter of the insertion groove.

5. The auxiliary contact mechanism of an electromagnetic contactor of claim 1, wherein the micro switch includes:

a housing;

a pair of terminals fixedly-installed in the housing and exposed to outside of the housing partially;

a leaf spring configured to connect or disconnect the pair of terminals to or from each other; and a contact button configured to apply a force to the leaf spring by the pressing member.

6. The auxiliary contact mechanism of an electromagnetic contactor of claim 1, wherein a minimum operating load of the elastic member is set to be smaller than a returning load required when the micro switch is closed, and wherein a maximum operating load of the elastic member is set to be larger than an operating load required when the micro switch is open.

7. The auxiliary contact mechanism of an electromagnetic contactor of claim 1, wherein a second elastic member is disposed between the auxiliary sliding member and the micro switch.

8. The auxiliary contact mechanism of an electromagnetic contactor of claim 1, further comprising a second sliding member which performs an up/down motion within the auxiliary sliding member, wherein the elastic member includes:

a first spring disposed on an upper surface of the second sliding member; and a second spring disposed between a lower surface of the second sliding member and the pressing member.

9. The auxiliary contact mechanism of an electromagnetic contactor of claim 8, wherein a spring constant of the first spring is set to be smaller than that of the second spring.

10. The auxiliary contact mechanism of an electromagnetic contactor of claim 8, wherein a maximum operating load of the first spring is set between an operating load required when the micro switch is open, and a returning load required when the micro switch is closed.

11. The auxiliary contact mechanism of an electromagnetic contactor of claim 8, wherein an operating load of the second spring is set to be larger than an operating load required when the micro switch is open.

* * * * *